US011396194B2

(12) United States Patent
Mizutani

(10) Patent No.: US 11,396,194 B2
(45) Date of Patent: Jul. 26, 2022

(54) PRINTER CONFIGURED TO ROTATE DISCHARGE ROLLER WHEN DETERMINING THAT SECOND PRINT CONTROL SUBSEQUENT TO FIRST PRINT CONTROL CAN BE PERFORMED

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 286 days.

(21) Appl. No.: 16/814,482

(22) Filed: Mar. 10, 2020

(65) Prior Publication Data

US 2020/0290379 A1 Sep. 17, 2020

(30) Foreign Application Priority Data

Mar. 14, 2019 (JP) ..... JP2019-046678

(51) Int. Cl.
*B41J 15/04* (2006.01)
*B41J 11/66* (2006.01)
(Continued)

(52) U.S. Cl.
CPC ..... *B41J 15/048* (2013.01); *B41J 3/4075* (2013.01); *B41J 11/006* (2013.01);
(Continued)

(58) Field of Classification Search
CPC ..... B41J 15/048; B41J 3/4075; B41J 11/006; B41J 11/0095; B41J 11/48; B41J 11/66; B41J 11/70; B41J 11/703; B41J 15/04
See application file for complete search history.

(56) References Cited

U.S. PATENT DOCUMENTS 6,447,186 B1 9/2002 Oguchi et al.
9,440,463 B2 9/2016 Kudo
(Continued)

FOREIGN PATENT DOCUMENTS

CN 1291550 A 4/2001
CN 101977775 A 2/2011
(Continued)

OTHER PUBLICATIONS

Chinese Office Action for the related Chinese Patent Application No. 202010173868.7 dated May 25, 2022.

*Primary Examiner* — Henok D Legesse
(74) *Attorney, Agent, or Firm* — Kenealy Vaidya LLP

(57) ABSTRACT

A printer includes: a printing head configured to perform printing on a medium; a conveyor configured to convey the medium in a conveying direction; a cutter configured to cut the medium to provide a segmented medium; a discharge roller; a counter roller configured to nip the medium in cooperation with the discharge roller; a driver configured to rotate the discharge roller in a discharging direction; and a controller configured to perform: (a) controlling the printing head and the conveyor to perform the first print control based on a first print instruction to perform printing on the medium; (b) driving the driver to stop rotation of the discharge roller with the medium nipped between the discharge roller and the counter roller; and (c) driving, when a second print control subsequent to the first print control is allowed, the driver to rotate the discharge roller in the discharging direction.

9 Claims, 9 Drawing Sheets

(51) Int. Cl.

| | |
|---|---|
| ***B41J 3/407*** | (2006.01) |
| ***B41J 11/00*** | (2006.01) |
| ***B41J 11/70*** | (2006.01) |
| ***B41J 11/48*** | (2006.01) |

(52) U.S. Cl.
CPC ..... *B41J 11/0095* (2013.01); *B41J 11/48* (2013.01); *B41J 11/66* (2013.01); *B41J 11/70* (2013.01); *B41J 11/703* (2013.01); *B41J 15/04* (2013.01)

(56) References Cited

U.S. PATENT DOCUMENTS

| | | | | |
|---|---|---|---|---|
| 10,207,523 | B2 * | 2/2019 | Yasui ..... | B41J 11/663 |
| 2005/0140944 | A1 | 6/2005 | Kamada | |
| 2011/0012979 | A1 | 1/2011 | Kitamura | |
| 2018/0326760 | A1 * | 11/2018 | Sasaki ..... | B65H 35/06 |

FOREIGN PATENT DOCUMENTS

| | | | |
|---|---|---|---|
| CN | 105620057 | A | 6/2016 |
| JP | 2000-194889 | A | 7/2000 |
| JP | 2004-315142 | A | 11/2004 |
| JP | 2005-41131 | A | 2/2005 |
| JP | 2005-187152 | A | 7/2005 |
| JP | 4566816 | B2 | 10/2010 |
| JP | 4566817 | B2 | 10/2010 |
| JP | 2017-43480 | A | 3/2017 |

* cited by examiner

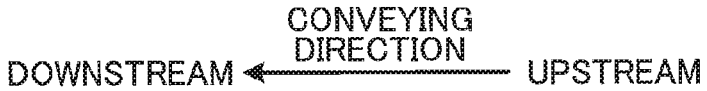
FIG. 7A
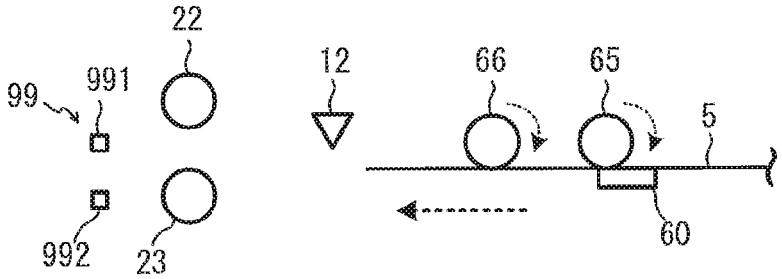
FIG. 7B
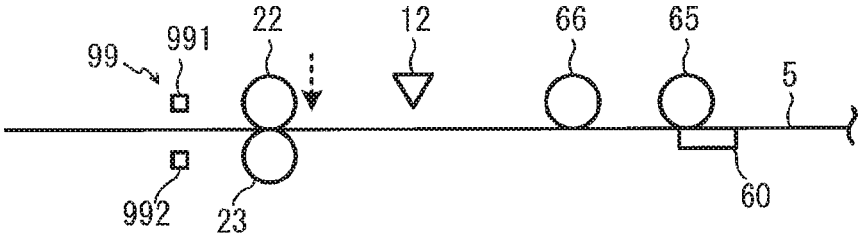
FIG. 7C
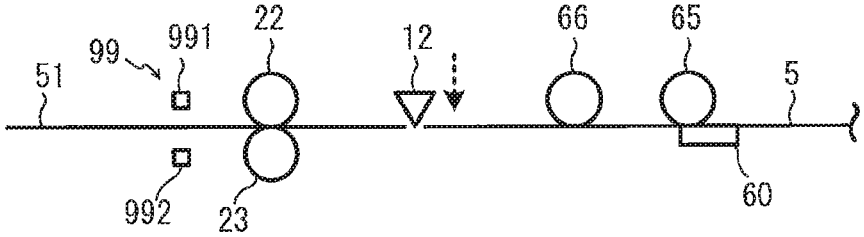
FIG. 7D
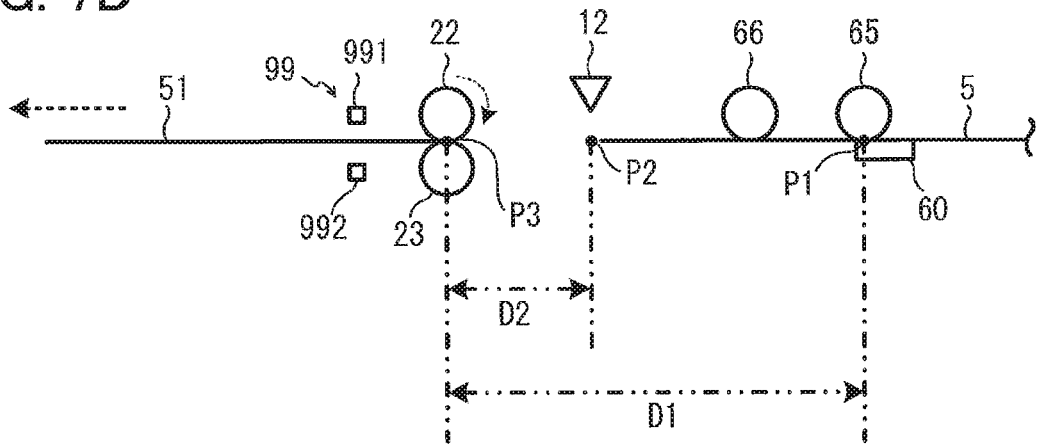

PRINTER CONFIGURED TO ROTATE DISCHARGE ROLLER WHEN DETERMINING THAT SECOND PRINT CONTROL SUBSEQUENT TO FIRST PRINT CONTROL CAN BE PERFORMED

CROSS REFERENCE TO RELATED APPLICATION

This application claims priority from Japanese Patent Application No. 2019-046678 filed Mar. 14, 2019. The entire content of the priority application is incorporated herein by reference.

TECHNICAL FIELD

The present disclosure relates to a printer.

BACKGROUND

Japanese Patent Application Publication No. 2017-43480 discloses a printer that performs printing on a medium. Once an image is printed on a medium, the medium is conveyed to a portion between a pair of discharge rollers, and is cut using a cutter in a state where the medium is nipped at the portion between the pair of discharge rollers. A sensor is configured to detect presence or absence of the medium cut by the cutter (hereinafter referred to as "segmented medium"). When the detection result by the sensor shows that the segmented medium has been removed from the portion between the discharge rollers, subsequent printing operation is enabled. The subsequent printing operation is performed upon receipt of new print instruction.

SUMMARY

In the above configuration, the sensor may erroneously detect that the segmented medium has been removed from the discharge rollers even though the segmented medium is still nipped by the discharge rollers. In this case, the subsequent printing operation becomes enabled in a state where the segmented medium remains nipped at the portion between the pair of discharge rollers. As a result, the nipped segmented medium may interfere with a medium on which the subsequent printing operation has been performed, leading to jam of the mediums in the printer.

In view of the foregoing, it is an object of the present disclosure provide a printer in which jam of a recording medium can be restrained.

In order to attain the above and other objects, according to one aspect, the disclosure provides a printer including: a printing head; a conveyor; a cutter; a discharge roller; a counter roller; a driver; and a controller. The printing head is configured to perform printing on a medium. The conveyor is configured to convey the medium in a conveying direction. The cutter is positioned downstream of the printing head and the conveyor in the conveying direction. The cutter is configured to cut the medium to provide a segmented medium. The discharge roller is positioned downstream of the cutter in the conveying direction. The counter roller is positioned to face the discharge roller and configured to nip the medium in cooperation with the discharge roller. The driver is configured to drivingly rotate the discharge roller in a discharging direction. Rotation of the discharge roller in the discharging direction causes the segmented medium to be conveyed downstream in the conveying direction. The controller is configured to perform: (a) controlling, when a first print instruction has been acquired, the printing head and the conveyor to perform a first print control on the medium, the first print control being first performed based on the acquired first print instruction to perform printing on the medium; (b) driving, when performing the (a) controlling, the driver to stop rotation of the discharge roller in a state where the medium is nipped at a portion between the discharge roller and the counter roller; and (c) driving, when a second print control is allowed to be performed, the driver to drivingly rotate the discharge roller in the discharging direction, the second print control being performed subsequent to the first print control based on a second print instruction acquired subsequent to the first print instruction to perform printing on the medium.

According to another aspect, the disclosure provides a printer including: a printing head; a platen roller; a cutter; a discharge roller; a counter roller; a sensor; and a controller. The printing head is configured to perform printing on a medium. The platen roller is configured to nip the medium in cooperation with the printing head. The cutter is positioned downstream of the printing head and the platen roller in a conveying direction in which the medium is conveyed. The cutter is configured to cut the medium to provide a segmented medium. The discharge roller is positioned downstream of the cutter in the conveying direction and is movable between a release position and a nipping position. The counter roller is positioned to face the discharge roller. The counter roller is configured to nip the medium in cooperation with the discharge roller at the nipping position. The counter roller is spaced away from the discharge roller at the release position to allow the medium to pass through a portion between the discharge roller and the counter roller. The sensor is positioned downstream of the discharge roller and the counter roller in the conveying direction. The sensor is configured to detect whether the segmented medium remains at the portion between the discharge roller and the counter roller. The controller configured to perform: (a) controlling, when a first print instruction has been acquired, the discharge roller to be moved to the release position; (b) controlling the printing head and the platen roller to perform printing on the medium based on the acquired first print instruction; (c) controlling, after completing the (b) controlling, the discharge roller to be moved to the nipping position; (d) controlling the cutter to provide the segmented medium; (e) preventing, when it is determined that the sensor detects that the segmented medium remains at the portion between the discharge roller and the counter roller, a second print instruction from being received, the second print instruction being acquired subsequent to the first print instruction to perform printing on the medium; (f) controlling, when it is determined that the sensor detects that the segmented medium has been removed from the portion between the discharge roller and the counter roller, the discharge roller to be rotated in a discharging direction; and (g) permitting, alter performing the (f) controlling, the second print instruction to be received.

BRIEF DESCRIPTION OF THE DRAWINGS

The particular features and advantages of the disclosure will become apparent from the following description taken in connection with the accompanying drawings, in which:

FIG. 7A is a schematic view for description of operation performed in the printer according to the first embodiment, and particularly illustrating a state where a print control is performed to a medium by a thermal head and a conveying roller in the printer;

FIG. 7B is a schematic view for description of the operation performed in the printer according to the first embodiment, and particularly illustrating a state where the medium is nipped by the discharge roller at the nipping position and a counter roller in the printer;

FIG. 7C is a schematic view for description of the operation performed in the printer according to the first embodiment, and particularly illustrating a state where the medium, is cut by a cutting blade in the printer and a segmented medium is provided;

FIG. 7D is a schematic view for description of the operation performed in the printer according to the first embodiment, and particularly illustrating a state where the segmented medium nipped between the discharge roller and the counter roller is discharged downward by rotation of the discharge roller;

DETAILED DESCRIPTION

Figure 1:
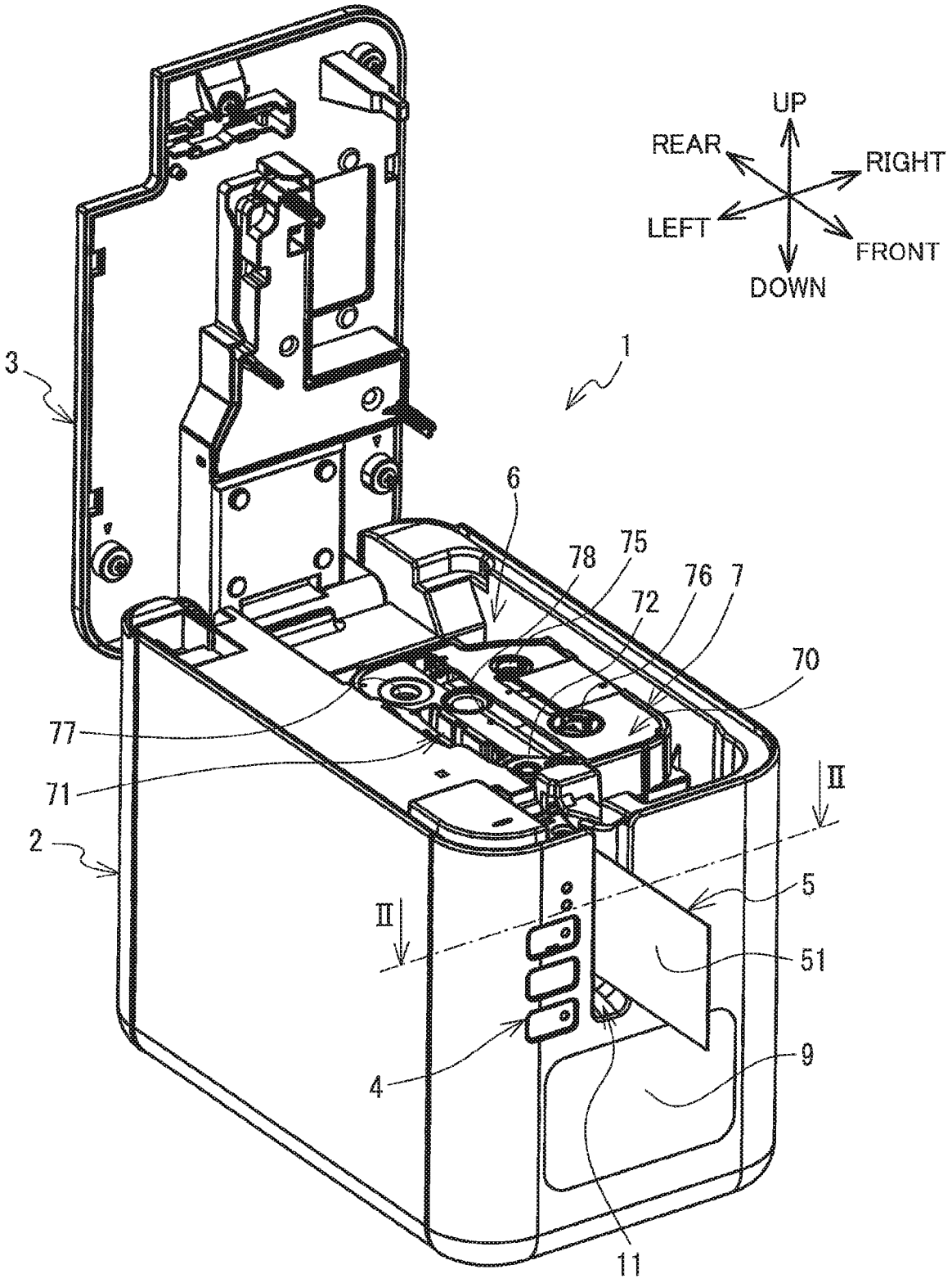
FIG. 1 is a perspective view of a printer according to a first embodiment of the present disclosure.

Hereinafter, a printer 1 according to a first embodiment of the present disclosure will be described with reference to FIGS. 1 through 4. Note that configuration of the printer 1 illustrated in the drawings is merely an example and is not intended to limit the present disclosure.

In the following description, directions with regard to the printer 1 will be described based on a posture of the printer 1 illustrated in FIG. 1. Specifically, a diagonally lower leftward direction, a diagonally upper rightward direction, a diagonally lower rightward direction, a diagonally upper leftward direction, an upward direction, and a downward direction in FIG. 1 are respectively defined as a leftward direction, a rightward direction, a frontward direction, a rearward direction, an upward direction and a downward direction of the printer 1, respectively.

The printer 1 can be connected to an external terminal device (not illustrated) such as a personal computer and a smartphone via a network and a cable (not illustrated). The printer 1 is configured to acquire print data from the external terminal device, for example, and to print an image on an image recording medium (hereinafter simply referred to as "medium") 5 on a basis of the acquired print data.

As illustrated in FIG. 1, the printer 1 includes a housing 2 and a cover 3. The cover 3 is pivotally movably supported by the housing 2 to open and close an upper open end of the housing 2. An input portion 4 is provided at a left-upper corner portion of a front surface of the housing 2. A user of the printer 1 can input various information into the printer 1 by operating the input portion 4. A display portion 9 is provided at a position below the input portion 4. The display portion 9 is configured to display various information thereon.

A discharge opening 11 is formed in the front surface of the housing 2 at a position rightward of the input portion 4. The discharge opening 11 is open and extends in an upward/downward direction. The discharge opening 11 is configured to discharge a segmented medium 51 (described later) to an outside of the housing 2. A cassette receiving portion 6 is provided at an upper portion of the housing 2. The cassette receiving portion 6 is recessed downward from the upper open end of the housing 2. A cassette 7 is attachable to and detachable from the cassette receiving portion 6.

Figure 2:
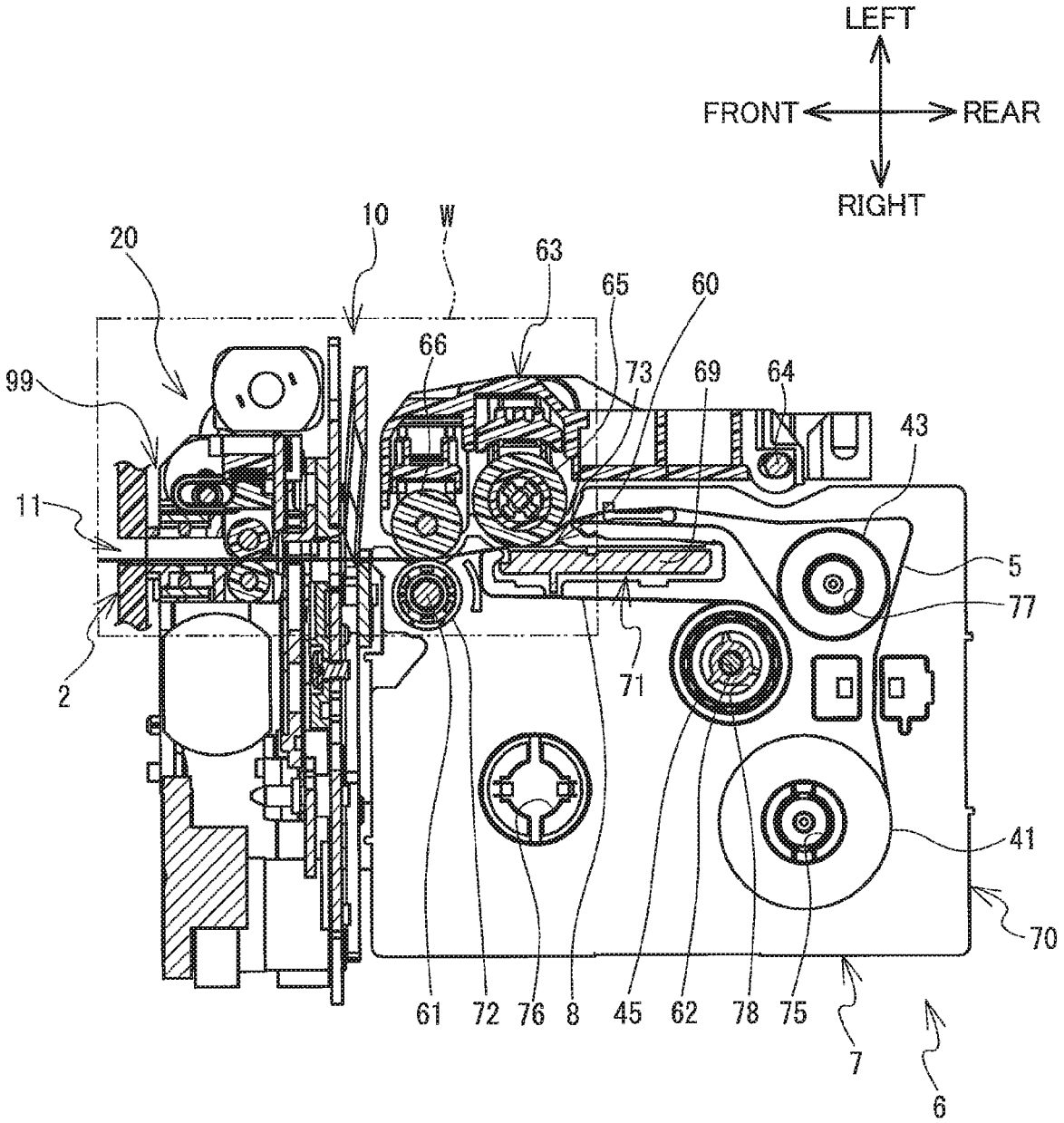
FIG. 2 is a cross-sectional view taken along a line II-II in FIG. 1 in which a housing of the printer according to the first embodiment is partially removed.

As illustrated in FIG. 2, the cassette receiving portion 6 includes a thermal head 60, a drive shaft 61, a ribbon take-up shaft 62, and a head holder 69. The head holder 69 is positioned at a left portion of the cassette receiving portion 6. The thermal head 60 is provided at a left surface of the head holder 69. The drive shaft 61 is positioned frontward of the head holder 69, and extends in the upward/downward direction. The ribbon take-up shaft 62 is positioned rightward and rearward of the head holder 69, and extends in the upward/downward direction.

A shaft 64 is provided at a position leftward of a rear portion of the cassette receiving portion 6. The shaft 64 extends in the upward/downward direction, and pivotally movably supports a rear end portion of a platen holder 63. The platen holder 63 rotatably supports a platen roller 65 and a conveying roller 66. The platen roller 65 faces the thermal head 60 from the left side thereof. The conveying roller 66 is at a position frontward of the platen roller 65, and faces the drive shaft 61 from the left side thereof. When the platen holder 63 is pivotally moved about an axis of the shaft 64, a front end portion of the platen holder 63 is moved in a direction substantially parallel to a leftward/rightward direction so that the platen roller 65 and the conveying roller 66 are moved between a position proximity to the thermal head 60 and the drive shaft 61 (see FIG. 2) and a position farther away from the thermal head 60 and the drive shaft 61 (not illustrated).

The drive shaft 61, the ribbon take-up shaft 62, the platen roller 65, and the conveying roller 66 are connected to a conveyer motor 91 (see FIG. 5) through a gear(s) (not illustrated). As the conveyer motor 91 starts to be driven, the drive shaft 61, the platen roller 65, and the conveying roller 66 are rotated to convey the medium 5 in a conveying direction (i.e., the frontward direction), and the ribbon take-up shaft 62 is rotated to take up an ink ribbon 8.

Figure 3:
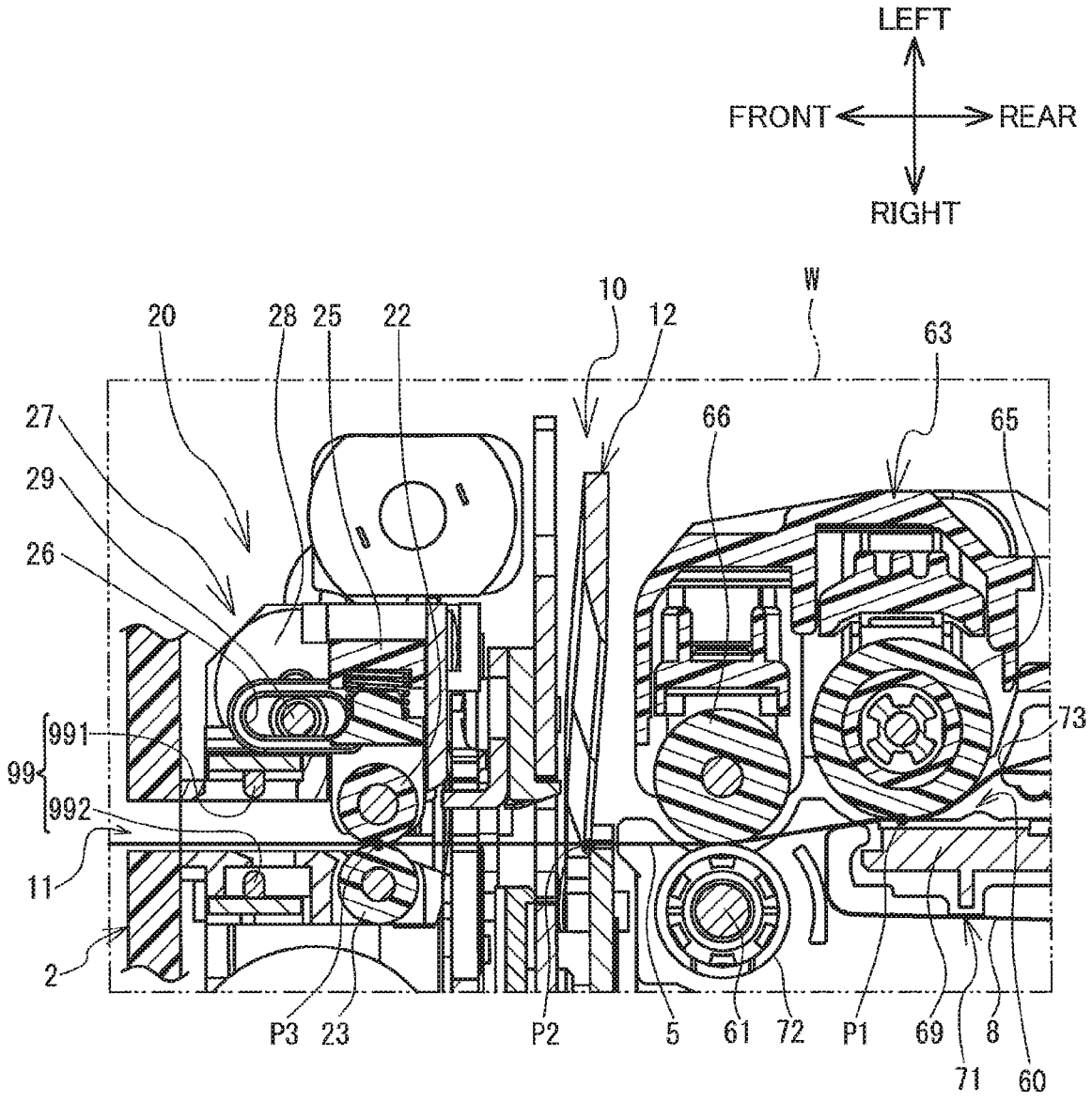
FIG. 3 is an enlarged view of a region illustrated in FIG. 2, and particularly illustrating a state where a discharge roller in the printer according to the first embodiment is at its nipping position.

As illustrated in FIG. 3, the printer 1 includes a cutter unit 10 and a discharge unit 20 those provided inside the housing 2 at a position adjacent to and rearward of the discharge opening 11. The cutter unit 10 includes a cutting blade 12. The cutting blade 12 is positioned downstream of both the thermal head 60 and the conveying roller 66 in the conveying direction and capable of cutting the medium 5, That is, the cutting blade 12 is capable of completely cutting the medium 5 into two separate parts. The cutting blade 12 is connected to a cutter motor 92 (see FIG. 5) through a gear(s) (not illustrated). When the cutter motor 92 starts to be driven, the cutting blade 12 cuts the medium 5.

In the following description, a portion of the medium 5 cut away by the cutting blade 12 will be referred to as "segmented medium 51" (see FIG. 1). That is, of the two separate parts of the medium 5, the segmented medium 51 is the leading portion cut away from the remaining portion of the medium 5 and discharged to the outside of the housing 2.

The discharge unit 20 includes a discharge roller 22, a counter roller 23, a roller holder 25, and a movable mechanism 27. The discharge roller 22 and the counter roller 23 are positioned downstream of the cutting blade 12 in the conveying direction. The discharge roller 22 extends in the upward/downward direction at a position leftward of the conveyed medium 5. The counter roller 23 extends in the upward/downward direction at a position rightward of the conveyed medium 5. The discharge roller 22 and the counter roller 23 face each other in the leftward/rightward direction with the conveyed medium 5 interposed therebetween. The discharge roller 22 and the counter roller 23 are made of elastic material.

The roller holder 25 supports the discharge roller 22, and is formed with an elongated slot 26. The movable mechanism 27 includes a rotator 28 and an eccentric shaft 29. The eccentric shaft 29 extends upward from the rotator 28 and is inserted through the elongated slot 26. The eccentric shaft 29 is eccentric with respect to the rotator 28, The rotator 28 is connected to a discharge motor 93 (see FIG. 5) through a gear(s) (not illustrated). A one-way clutch (not illustrated) is provided at the gear(s). The discharge motor 93 is driven and can make forward rotation and make reverse rotation.

Figure 4:
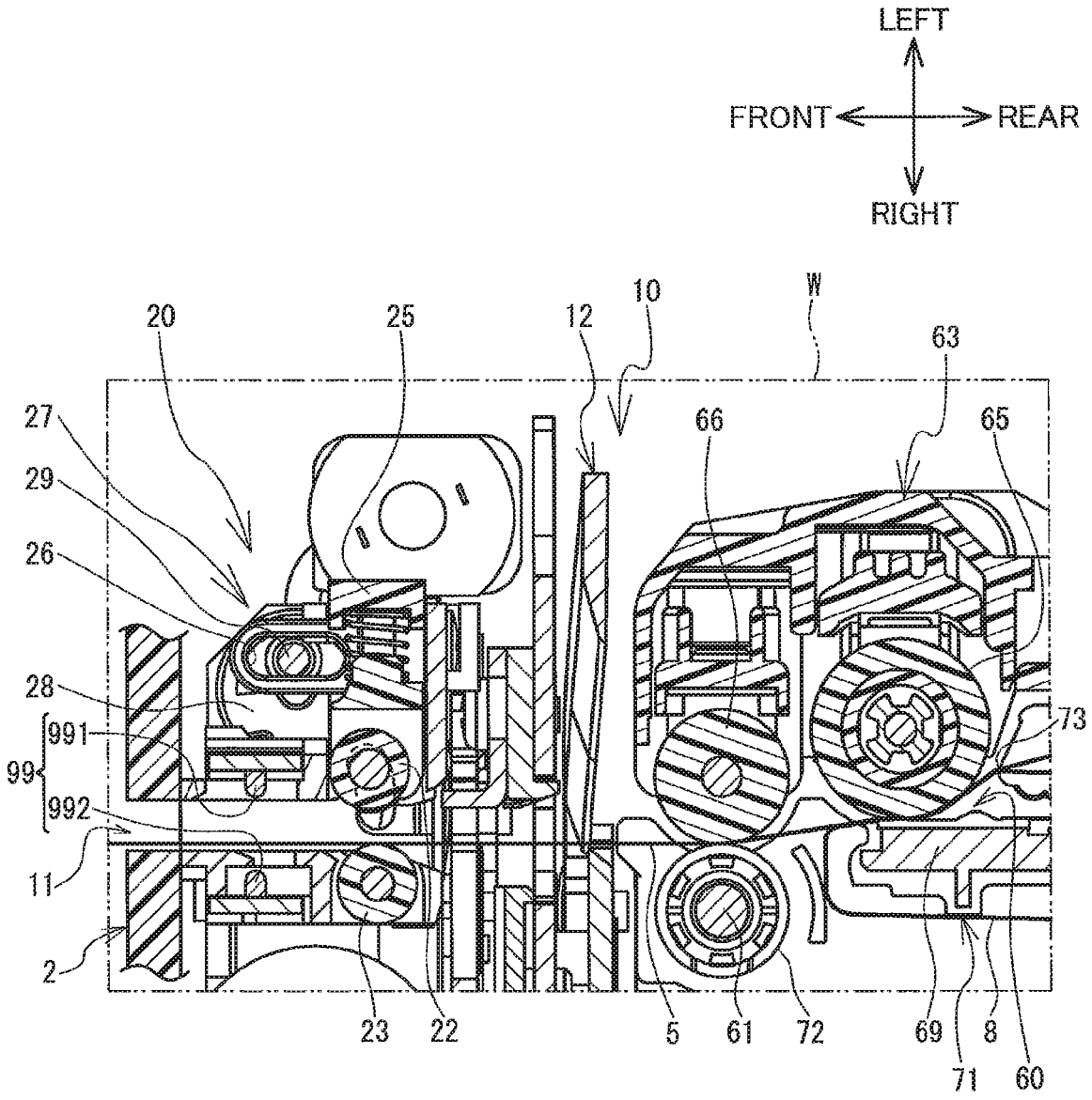
FIG. 4 is an enlarged view of the region illustrated in FIG. 2, and particularly illustrating a state where the discharge roller in the printer according to the first embodiment is at its release position.

As illustrated in FIGS. 3 and 4, in accordance with the reverse rotation of the discharge motor 93, the rotator 28 is rotated through the gear(s), whereby the eccentric shaft 29 moves the roller holder 25 in the leftward/rightward direction. In this way, the movable mechanism 27 moves the discharge roller 22 toward and away from the counter roller 23. In the following description, a position Where the discharge roller 22 is in the proximity to the counter roller 23 will be referred to as "nipping position" (see FIG. 3), and a position where the discharge roller 22 is positioned leftward and away from the counter roller 23 will be referred to as "release position" (see FIG. 4).

As illustrated in FIG. 3, the discharge roller 22 at the nipping position is in contact with the counter roller 23. With this configuration, the medium 5 conveyed by the conveying roller 66 is nipped between the discharge roller 22 and the counter roller 23 when the discharge roller 22 is at the nipping position. As illustrated in FIG. 4, the discharge roller 22 is positioned away from the counter roller 23 with a gap greater than a thickness of the medium 5 when the discharge roller 22 is at the release position. Hence, the discharge roller 22 at the release position is positioned away from the conveyed medium 5.

When the discharge motor 93 makes forward rotation, the discharge roller 22 rotates in a discharging direction so that the segmented medium 51 is conveyed downstream in the conveying direction. In the present embodiment, the discharging direction is a clockwise direction in plan view in FIG. 3. Even when the discharge motor 93 makes forward rotation, the rotation of the rotator 28 is prevented by the function of the one-way clutch. Accordingly, the discharge roller 22 rotates in the discharging direction while the position of the discharge roller 22 is maintained at the nipping position.

A printing line P1 illustrated in FIG. 3 is a position in the conveying direction where the medium 5 is nipped between the platen roller 65 and the thermal head 60. A cutting line P2 is a position in the conveying direction where the cutting blade 12 cuts the medium 5 to provide a segmented medium 51. A nipping line P3 is a position in the conveying direction where the medium 5 is nipped at a portion between the discharge roller 22 at the nipping position and the counter roller 23. The printing line P1, the cutting line P2, and the nipping line P3 are arrayed in this order in the conveying direction.

Next, the cassette 7 will next be described with reference to FIG. 2. Description as to the configuration of the cassette 7 will be made based on a posture of the cassette 7 attached to the cassette receiving portion 6. Cassettes of a receptor type, a thermal type, a laminate type and the like are available as the cassette 7. FIG. 2 illustrates the receptor type cassette 7 as an example.

The cassette 7 includes a case 70, and a drive roller 72. The case 70 is formed with a head opening 71 and a medium ejection opening 73 at a left-front portion thereof. The head opening 71 penetrates the case 70 in the upward/downward direction, and opens leftward at a position between the medium ejection opening 73 and the drive roller 72. The head holder 69 and the thermal head 60 are positioned within the head opening 71. The medium ejection opening 73 is formed at a position leftward of the head opening 71, and opens frontward.

The drive roller 72 is positioned at a left-front corner portion of the case 70 and extends in the upward/downward direction. The drive roller 72 has a hollow cylindrical shape and is rotatably supported by the case 70. The drive shaft 61 is inserted into the drive roller 72. The drive roller 72 has a left end portion exposed to an outside of the case 70 to nip the medium 5 in cooperation with the conveying roller 66.

Further, the case 70 is formed with support holes 75, 76, 77, and 78 penetrating the case 70 in the upward/downward direction. The support hole 75 rotatably supports a first medium spool 41 around which a first medium is wound. The support hole 76 is configured to rotatably support a second medium spool (not illustrated) around which a second medium is wound. The support hole 77 rotatably supports a ribbon supply spool 43 around which the ink ribbon 8 prior to printing is wound. The support hole 78 rotatably supports a ribbon take-up spool 45 around which the ink ribbon 8 already used for printing is wound. The ribbon take-up shaft 62 is inserted into the ribbon take-up spool 45.

In the receptor type cassette 7, the second medium spool for winding the second medium is not provided and thus not illustrated in the cassette 7 in FIG. 2, but the first medium spool 41 for winding the medium 5 as the first medium, the ribbon supply spool 43 and the ribbon take-up spool 45 are provided. As the medium 5, a non-laminate tape, a fabric tape, a satin tape, and a heat-shrink tube are available. Regarding the thermal type cassette, the second medium spool, the ribbon supply spool 43 and the ribbon take-up spool 45 are not provided, but the first medium spool 41 is provided. A heat sensitive tape is used as the first medium.

Regarding the laminate type cassette, the first medium spool 41, the second medium spool, the ribbon supply spool 43, and the ribbon take-up spool 45 are provided. Double-sided adhesive tape is used as the first medium. A film tape is used as the second medium. The double-sided adhesive tape is superposed on the film tape at a position between the conveying roller 66 and the drive roller 72, and is discharged together as a laminate tape.

With the above configuration, as the cover 3 (see FIG. 1) is closed, the platen roller 65 and the conveying roller 66 are moved rightward toward and approaches the thermal head 60 and the drive shaft 61 from the left side thereof, respectively. Hence, the platen roller 65 urges both the medium 5 and the ink ribbon 8 against the thermal head 60 with the medium 5 and the ink ribbon 8 superposed on each other. The conveying roller 66 urges the medium 5 against the drive roller 72.

When the ribbon take-up shaft 62 is rotated in accordance with driving of the conveyer motor 91 (see FIG. 5), the ink ribbon 8 is drawn out from the ribbon supply spool 43 since the ribbon take-up spool 45 takes up the ink ribbon 8. The drawn out ink ribbon 8 is pulled to a left-front portion of the head opening 71 through the medium ejection opening 73, and then is moved past a portion between the platen roller 65 and the thermal head 60 to be conveyed toward the ribbon take-up spool 45.

As the drive shaft 61, the platen roller 65 and the conveying roller 66 is rotated due to the driving of the conveyer motor 91, the medium 5 is drawn out from the first medium spool 41. The drawn out medium 5 is pulled to the left-front portion of the head opening 71 through the medium ejection opening 73. Then, the medium 5 is moved past the portion between the platen roller 65 and the thermal head 60 and a portion between the conveying roller 66 and the drive roller 72, and is conveyed toward the cutter unit 10.

Figure 5:
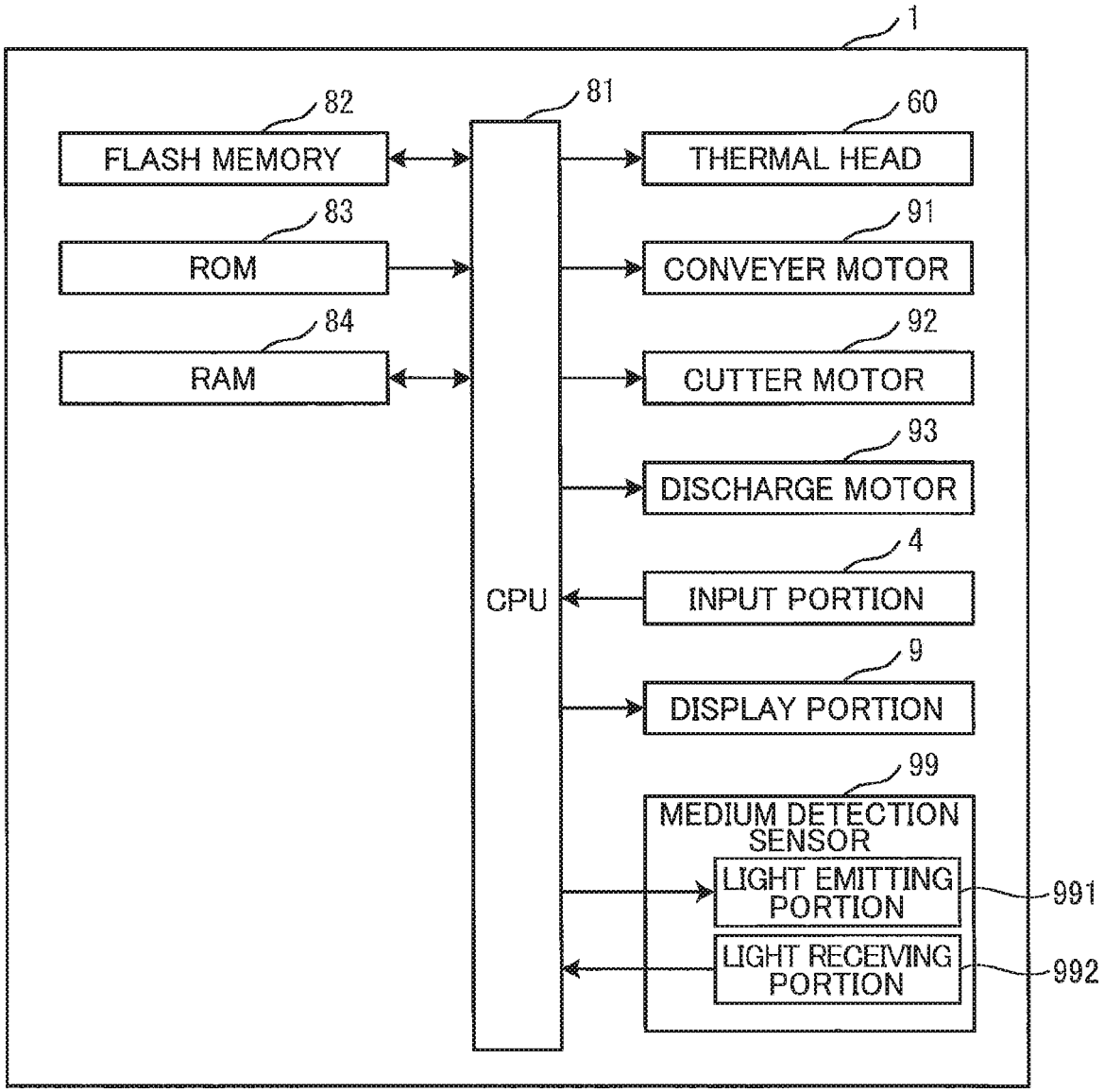
FIG. 5 is a block diagram illustrating an electrical configuration in the printer according to the first embodiment.

An electrical configuration in the printer 1 will next be described with reference to FIG. 5. As illustrated in FIG. 5, the printer 1 further includes a CPU 81. The CPU 81 functions as a processor for executing a first main routine (described later) illustrated in FIG. 6 to perform overall control of the printer 1. A flash memory 82, a ROM 83, a RAM 84, the thermal head 60, the conveyer motor 91, the cutter motor 92, the discharge motor 93, the input portion 4, the display portion 9, and a medium detection sensor 99 are connected to the CPU 81.

The flash memory 82 is a non-transitory storage medium that stores therein programs for the CPU 81 to execute the first main routine and printing information for the thermal head 60 to perform printing on the medium 5. The ROM 83 is a non-transitory storage medium configured to store therein various parameters needed in the CPU 81 to execute various programs. The RAM 84 is a transitory storage medium configured to store therein temporary data of timer, counter and a flag.

The medium detection sensor 99 is positioned downstream of the cutting line P2, and specifically, positioned downstream of the nipping line P3 (see FIG. 3) in the conveying direction. The medium detection sensor 99 is a transmissive photosensor and includes a light emitting portion 991 and a light receiving portion 992. The light emitting portion 991 and the light receiving portion 992 are positioned to oppose each other with respect to a conveying passage of the medium 5 (see FIG. 3).

The medium detection sensor 99 is configured to output ON signal to the CPU 81 in a case where there remains the segmented medium 51 nipped at the position between the discharge roller 22 and the counter roller 23. On the other hand, the medium detection sensor 99 is configured to output OFF signal to the CPU 81 in a case where no segmented medium 51 is nipped at the position between the discharge roller 22 and the counter roller 23. In this way, the medium detection sensor 99 detects whether the segmented medium 51 is nipped between the discharge roller 22 and the counter roller 23.

Next, the first main routine will be described with reference to FIGS. 6 to 71). In a state where the cassette 7 is attached to the cassette receiving portion 6 and the cover 3 is closed, the printer 1 is powered by a user. As electric power is supplied to the printer 1, the CPU 81 expands in the RAM 84 program stored in the flash memory 82 to start the first main routine. In FIGS. 7A through 7D, movement of each component in the printer 1 is indicated by broken lines.

Figure 6:
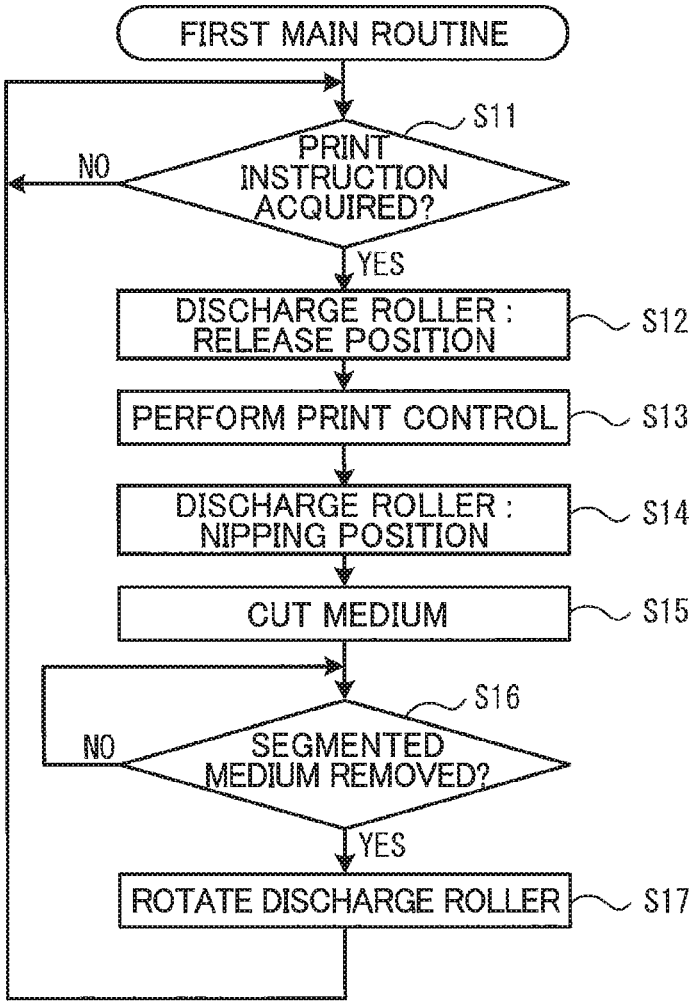
FIG. 6 is a flowchart illustrating a first main routine executed by a CPU in the printer according to the first embodiment.

As illustrated in FIG. 6, at the beginning of the first main routine, in S11 the CPU 81 determines whether print instruction for performing printing on the medium 5 has been acquired. The print instruction includes print information. The user inputs print instruction to the printer 1 by operating the external terminal device. When the CPU 81 determines that print instruction has not been acquired (S11: NO), the CPU 81 repeatedly executes the process in S11 until the print instruction is inputted.

When the CPU 81 determines that the CPU 81 has acquired print instruction through the network, the cable and the like (S11: YES), in S12 the discharge motor 93 is driven to make reverse rotation to move the discharge roller 22 to the release position (see FIG. 4). Accordingly, the discharge roller 22 does not prevent the conveyance of the medium 5 when the print control is performed.

In S13 the CPU 81 performs print control. As illustrated in FIG. 7A, during the print control, the CPU 81 controls the conveyer motor 91 and the thermal head 60 based on the print information included in the acquired print instruction. Therefore, printing on the medium 5 by the thermal head 60 is performed while the medium 5 is conveyed by the conveying roller 66.

As illustrated in FIG. 6, in S14 the CPU 81 controls the discharge motor 93 to make reverse rotation so that the discharge roller 22 is moved to the nipping position (see FIG. 3). As a result, the medium 5 is nipped at the position between the discharge roller 22 and the counter roller 23 as illustrated in FIG. 7B. In this state, the CPU 81 prevents the discharge motor 93 from making forward rotation that causes rotation of the discharge roller 22. That is, a state where the medium 5 is nipped between the discharge roller 22 and the counter roller 23 is maintained.

As illustrated in FIG. 6, in S15 the CPU 81 drives the cutter motor 92 to cut the medium 5 by the cutting blade 12 while the forward rotation of the discharge motor 93 is prevented, i.e., the rotation of the discharge roller 22 is halted. Hence, the segmented medium 51 is provided as illustrated in FIG. 7C.

Referring back to FIG. 6, in S16 the CPU 81 determines whether the segmented medium 51 has been removed from the portion between the discharge roller 22 and the counter roller 23 based on a detection signal transmitted from the medium detection sensor 99. When the CPU 81 receives ON signal from the medium detection sensor 99, the CPU 81 determines that the segmented medium 51 has not been removed from the portion between the discharge roller 22 and the counter roller 23 (S16: NO), i.e., the segmented medium 51 remains at the position between the discharge roller 22 and the counter roller 23. In this case, the process in S16 is repeatedly executed until OFF signal is outputted from the medium detection sensor 99. At this time, the CPU 81 cannot receive print instruction in S11 unless the CPU 81 determines in S16 that the segmented medium 51 is removed by the user. Consequently, new print control subsequent to the current print control is prevented.

When the CPU 81 receives OFF signal from the medium detection sensor 99, the CPU 81 determines that the segmented medium 51 has been removed from the discharge roller 22 and the counter roller 23 (S16: YES), i.e., there is no segmented medium 51 nipped between the discharge roller 22 and the counter roller 23. In this case, in S17 the CPU 81 controls the discharge motor 93 to make forward rotation by a prescribed amount to cause the discharge roller 22 to be rotated in the discharging direction.

Normally, when the segmented medium 51 has been removed by the user from the portion between the discharge roller 22 and the counter roller 23, the medium detection sensor 99 outputs OFF signal. However, the medium detection sensor 99 may erroneously output OFF signal in spite of the fact that the segmented medium 51 still remains at the portion between the discharge roller 22 and the counter roller 23, i.e., the segmented medium 51 has not been removed by the user.

In this case, if subsequent print control is performed while the segmented medium 51 remains at the portion between the discharge roller 22 and the counter roller 23, and if the segmented medium 51 is displaced upstream in the conveying direction (toward the cutting blade 12), the medium 5 printed during the subsequent print control and the remaining segmented medium 51 may overlap each other, and both the medium 5 and the remaining segmented medium 51 may be cut together by the cutting blade 12, which may cause damages to the cutting blade 12. Further, the newly printed medium 5 may interfere with the remaining segmented medium 51, to cause jam of the mediums in the printer 1.

In view of the foregoing, in S17, even if the segmented medium 51 still remains at the position between the discharge roller 22 and the counter roller 23, the printer 1 rotates the discharge roller 22 in the discharging direction and conveys the remaining segmented medium 51 downstream in the conveying direction from the portion between the discharge roller 22 and the counter roller 23 to discharge the segmented medium 51 prior to subsequent print control is performed (see FIG. 7D). Hence, the printer 1 can suppress the subsequent print control from being executed in the state where the segmented medium 51 remains at the portion between the discharge roller 22 and the counter roller 23. Consequently, tile printer 1 can avoid jam of the mediums therein and damages to the cutting blade 12.

The prescribed amount (i.e., an amount of forward rotation of the discharge motor 93 in S17) denotes an amount of the forward rotation corresponding to a distance in the conveying direction smaller than a distance D1 in the conveying direction between the printing line P1 and the nipping line P3 and greater than a distance D2 in the conveying direction between the cutting line P2 and the nipping line P3. In other words, when the discharge motor 93 makes forward rotation by the prescribed amount in S17, the discharge roller 22 is rotated to convey tile segmented medium 51 by a distance smaller than the distance D1 and greater than the distance D2.

Incidentally, the distance in the conveying direction is defined along the conveying passage of the medium 5. In the present embodiment, the distance D1 is a linear distance between the printing line P1 and the nipping line P3, and the distance D2 is a linear distance between the cutting line P2 and the nipping line P3.

As illustrated in FIG. 6, after executing the process in S17, the CPU 81 returns to the process in S11. In this state, the CPU 81 is ready to receive new print instruction in S11 in accordance with the rotation of the discharge roller 22 in the discharging direction in S17. Consequently, subsequent print control can be performed. In this way, the CPU 81 determines whether to allow subsequent control to be performed on a basis of the detection signal outputted by the medium detection sensor 99.

As described above, after the print control is performed, forward rotation of the discharge motor 93 is prevented in the state where the medium 5 is nipped at the portion between the discharge roller 22 and the counter roller 23. Hence, the cutting blade 12 can cut the medium 5 while the rotation of the discharge roller 22 is halted. As the cutter motor 92 is driven, the cutting blade 12 is caused to cut the medium 5 to provide a segmented medium 51. Thereafter, the user can take out the segmented medium 51 from the portion between the discharge roller 22 and the counter roller 23.

In a case where the execution of subsequent print control is determined to be permitted (i.e., the segmented medium 51 is determined to be removed), the discharge motor 93 is driven to make forward rotation to rotate the discharge roller 22 in the discharging direction prior to start of the subsequent print control. Accordingly, even when the medium detection sensor 99 erroneously detects that the segmented medium 51 does not remain in spite of the fact that the segmented medium 51 still exists at the position between the discharge roller 22 and the counter roller 23, the segmented medium 51 can be discharged from the portion between the discharge roller 22 and the counter roller 23 to the downstream side thereof in the conveying direction by the rotation of the discharge roller 22.

Consequently, the printer 1 according to the present embodiment can suppress execution of subsequent print control in the state where the segmented medium 51 still remains at the portion between the discharge roller 22 and the counter roller 23, thereby restraining jam of the media in the printer 1.

The CPU 81 determines that execution of subsequent print control is permitted in response to detecting, through the medium detection sensor 99, that the segmented medium 51 has been removed from the portion between the discharge roller 22 and the counter roller 23. This configuration can prevent the subsequent print control from starting before the user removes the segmented medium 51 away from the portion between the discharge roller 22 and the counter roller 23. Accordingly, jam of the media within the printer 1 can further be prevented.

The medium detection sensor 99 is positioned downstream of the discharge roller 22 in the conveying direction. Therefore, the printer 1 does not require a space for positioning the medium detection sensor 99 at a position between the cutting blade 12 and the discharge roller 22 in the conveying direction. Hence, the distance in the conveying direction between the cutting blade 12 and the discharge roller 22 can be reduced. Accordingly, a length of margin (a region in Which printing is not performed) of the medium 5 can be reduced.

Further, even if the medium detection sensor 99 erroneously detects absence of the segmented medium 51 due to an external light entered in the printer 1, the segmented medium 51 can be securely discharged by the rotation of the discharge roller 22 in the discharging direction prior to start of subsequent print control, thereby avoiding jam of the mediums in the printer 1. Thus, the printer 1 can reduce a length of margin in the medium 5 and can avoid occurrence of jam of the mediums.

Further, the prescribed amount of the forward rotation of the discharge motor 93 in S17 is constant. Accordingly, even when the segmented medium 51 remains at the portion between the discharge roller 22 and the counter roller 23, the printer 1 can securely discharge the remaining segmented medium 51 to the downstream of the discharge roller 22 and the counter roller 23 in the conveying direction. Hence, the printer 1 can further avoid occurrence of jam of the mediums.

The prescribed amount of the forward rotation of the discharge motor 93 in S17 is smaller than an amount of the forward rotation of the discharge motor 93 causing the segmented medium 51 to be conveyed by the distance D1 between the printing line P1 and the nipping line P3 in the conveying direction. Therefore, the printer 1 can shorten a cycle time (a period of time) until the subsequent print control is started. Hence, prolongation of the cycle time can be restrained while avoiding jam of the mediums in the printer 1.

Further, the prescribed amount of the forward rotation of the discharge motor 93 in S17 is greater than an amount of the forward rotation of the discharge motor 93 causing the segmented medium 51 to conveyed by the distance D2 (see FIG. 7) between the cutting line P2 and the nipping line P3 in the conveying direction. Accordingly, even when the segmented medium 51 remains at the portion between the discharge roller 22 and the counter roller 23, the printer 1 can securely discharge the segmented medium 51 out of the portion between the discharge roller 22 and the counter roller 23 to the downstream side in the conveying direction. Thus, the printer 1 can further avoid jam of the mediums.

Next, a printer 1 according to a second embodiment will be described with reference to FIG. 8. Mechanical configuration of the printer 1 according to the second embodiment is the same as that of the printer 1 according to the first embodiment. The second embodiment is different from the first embodiment in that the CPU 81 executes a second main routine illustrated in FIG. 8 in place of the first main routine. In the second main routine, the process in S161 is executed instead of the process in S16 of the first main routine. The remaining processes in S11 to S15 and S17 are the same as those in the first main routine so that the description as to these processes will be omitted to avoid duplicating description. As the printer 1 is powered by the user, the CPU 81 expands in the RAM 84 program stored in the flash memory 82 to start the second main routine.

Figure 8:
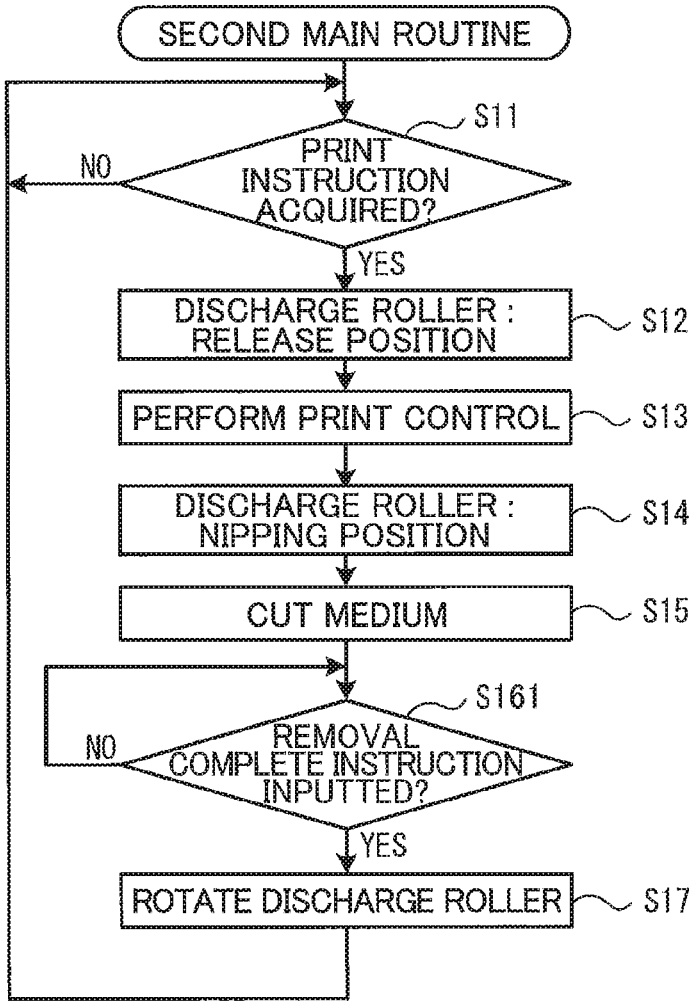
FIG. 8 is a flowchart illustrating a second main routine executed by a CPU in a printer according to a second embodiment.

As illustrated in FIG. 8, after executing the process in S15, in S161 the CPU 81 determines whether removal complete instruction has been acquired. Here, after the user removes the segmented medium 51 away from the portion between the discharge roller 22 and the counter roller 23, the user inputs removal complete instruction to the printer 1 by operating the input portion 4. When the CPU 81 determines in S161 that the removal complete instruction has not been acquired (S161: NO), the CPU 81 repeatedly executes the process in S161 until the removal complete instruction has been inputted. Accordingly, the CPU 81 cannot receive new print instruction in S11 unless the CPU 81 determines that the removal complete instruction has been acquired in S161. Thus, execution of subsequent print control is prevented.

On the other hand, when the CPU 81 determines that the removal complete instruction has been acquired (S161: YES), the CPU 81 advances to the process in S17. Hence, the CPU 81 is allowed to receive new print instruction in S11 in accordance with the rotation of the discharge roller 22 in the discharging direction in S17, whereby subsequent print control can be performed. In this way, the CPU 81 determines whether the subsequent print control can be performed based on whether removal complete instruction has been acquired from the user.

Similar to the first embodiment, according to the second embodiment, when the CPU 81 determines that execution of subsequent print control is permitted, the discharge motor 93 is driven to make forward rotation to rotate the discharge roller 22 in the discharging direction before starting the subsequent print control. As a result, occurrence of jam of the mediums in the printer 1 can be restrained.

Further, in the second embodiment, after removing the segmented medium 51 from the portion between the discharge roller 22 and the counter roller 23, the user inputs removal complete instruction into the printer 1. Therefore, the printer 1 can securely prevent subsequent print control from starting before the user removes the segmented medium 51 from the portion between the discharge roller 22 and the counter roller 23. This operation can further restrain occurrence of jam of the mediums in the printer 1.

Figure 9:
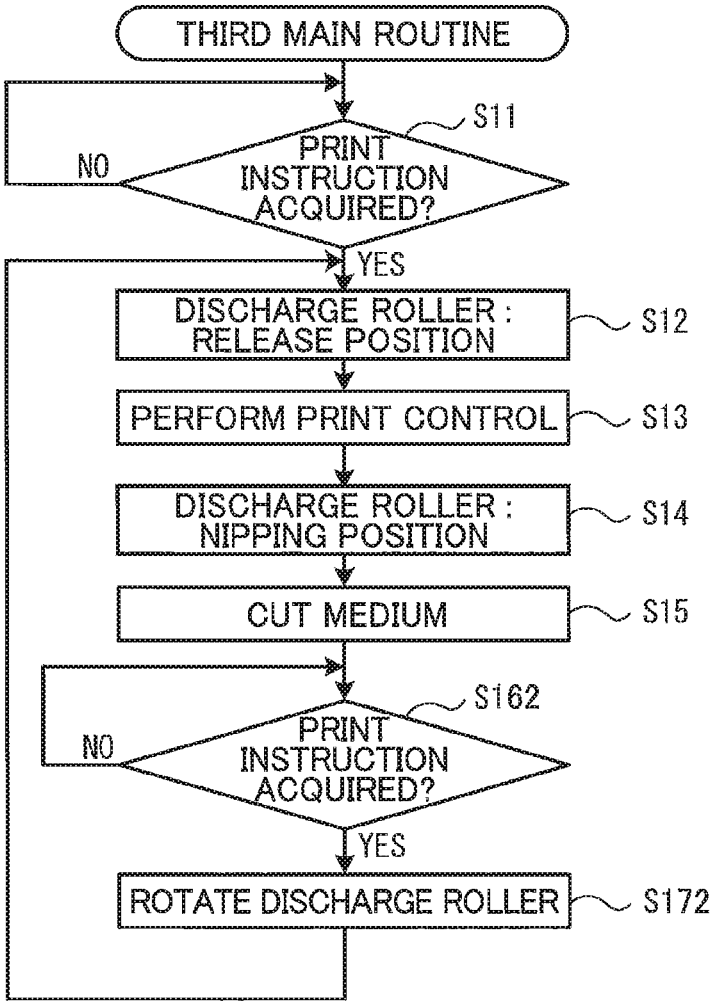
FIG. 9 is a flowchart illustrating a third main routine executed by a CPU in a printer according to a third embodiment.

Next, a printer 1 according to a third embodiment will be described with reference to FIG. 9. Note that mechanical configuration of the printer 1 according to the third embodiment is the same as that of the first embodiment and the second embodiment. The third embodiment differs from the first embodiment in that a third main routine is executed instead of the first main routine in the first embodiment. In the third main routine, the CPU 81 executes the process in S162 and S172 instead of the process in S16 and S17 in the first main routine, respectively. In FIG. 9, the processes the same as those in the first embodiment will be designated by the same step numerals as those shown in FIG. 6 to avoid duplicating description. When the printer 1 is powered by the user, the CPU 81 expands in the RAM 84 program stored in the flash memory 82 to start the third main routine.

As illustrated in FIG. 9, after executing the process in S15, in S162 the CPU 81 determines whether new print instruction has been acquired. After the user removes the segmented medium 51 from the portion between the discharge roller 22 and the counter roller 23, the user to inputs new print instruction to the printer 1 by operating the external terminal device. When the CPU 81 determines that new print instruction has not been acquired (S162: NO), the process in S162 is repeatedly executed until the new print instruction is inputted. Accordingly, execution of subsequent print control is prevented until the CPU 81 determines that print instruction has been acquired in S162.

When the CPU 81 determines that the CPU 81 has acquired new print instruction (S162: YES), in S172 the CPU 81 drives the discharge motor 93 to make forward rotation by the prescribed amount to rotate the discharge roller 22 in the discharging direction, and then the CPU 81 returns to the process in S12, whereupon subsequent print control is allowed. Accordingly, subsequent print control is allowed to be executed in response to the rotation of the discharge roller 22 in the discharging direction in S172. In this way, the CPU 81 determines whether execution of subsequent print control is to be permitted on a basis of whether new print instruction has been inputted.

Similar to the first and second embodiments, according to the third embodiment, when the execution of subsequent print control is determined to be permitted, the discharge motor 93 is driven to make forward rotation to rotate the discharge roller 22 in the discharging direction before starting subsequent print control. As a result, as in the first and second embodiments, occurrence of jam of the mediums can be securely obviated according to the printer 1 in the third embodiment.

According to the third embodiment, after removing the segmented medium 51 from the portion between the discharge roller 22 and the counter roller 23, the user inputs new print instruction into the printer 1. Therefore, the printer 1 can prevent subsequent print control from starting before the user removes the segmented medium 51 from the portion between the discharge roller 22 and the counter roller 23. Hence, occurrence of jam of the mediums in the printer 1 can further be restrained. After the user removes the segmented medium 51 from the portion between the discharge roller 22 and the counter roller 23, the user can urge the printer 1 to execute subsequent print control just by inputting a single instruction (i.e., new print instruction) to the printer 1.

While the description has been made in detail with reference to the first through third embodiments, it would be apparent to those skilled in the art that various changes and modifications may be made thereto.

For example, after executing the process in S15 and before the process in S17, the CPU 81 may execute both the processes in S16 and S161. In this case, after the process in S15, the CPU 81 determines that the segmented medium 51 has been removed in S16 and that removal complete instruction has been acquired in S161, and then proceeds to the process in S17. Further, in the first and second main routines, the CPU 81 returns to the process in S11 after the process in S17 is executed. However, the process in S17 may be executed after the process in S11 and before the process in S12, not before the process in S11.

Further, the prescribed amount of the forward rotation of the discharge motor 93 may be greater than the amount of the forward rotation of the discharge motor 93 causing the segmented medium 51 to be conveyed by the distance D1. That is, the segmented medium 51 may be conveyed in S17 by a distance greater than the distance D1. In this case, the segmented medium 51 can be securely removed from the portion between the discharge roller 22 and the counter roller 23 before subsequent print control is executed even if the segmented medium 51 still remains at the portion between the discharge roller 22 and the counter roller 23.

Further, the prescribed amount of the forward rotation of the discharge motor 93 may be smaller than the amount of the forward rotation of the discharge motor 93 causing the segmented medium 51 to be conveyed by the distance D2. That is, the segmented medium 51 may be conveyed in S17 by a distance smaller than the distance D2. In the latter case, the cycle time can be reduced while the segmented medium 51 can be discharged from the portion between the discharge roller 22 and the counter roller 23 prior to start of subsequent print control.

In the first through third embodiments, the user inputs print instruction by operating the external terminal device. However, the print instruction may be inputted into the printer 1 by the user's operation of the input portion 4. Further, in the second embodiment, the removal complete instruction is inputted into the printer 1 by the user operating the input portion 4. However, the user may input the removal complete instruction into the printer 1 by operating the external terminal device.

The discharge roller 22 at the nipping position may be positioned to face the counter roller 23 with a gap smaller than the thickness of the medium 5. Further, the discharge roller 22 at the release position may be separated from the counter roller 23 with a gap smaller than the thickness of the medium 5 provided that a load applied by the discharge roller 22 to the medium 5 to urge the medium 5 toward the counter roller 23 is smaller than that applied by the discharge roller 22 at the nipping position.

Further, the discharge roller 22 may not be movable between the nipping position and the release position. For example, the discharge roller 22 may be immovably positioned to be in contact with the counter roller 23, or may be immovably positioned to be spaced away from the counter roller 23 with a gap smaller than the thickness of the medium 5. The counter roller 23 may be movable relative to the discharge roller 22. Alternatively, both the discharge roller 22 and the counter roller 23 may be movable. Further, components for nipping the medium 5 during cutting operation by the cutting blade 12 may be provided in addition to the discharge roller 22 and the counter roller 23.

The counter roller 23 may be a member that is not rotatable, i.e., may not be a roller. In this case, a plate-like member may be employed instead of the counter roller 23. Further, at least one of the discharge roller 22 and the counter roller 23 may be formed of a material other than elastic material. The printer 1 may not be provided with the cutter motor 92, but a user may manually operate a cutting blade to cut the medium 5. In this case, a sensor for detecting that the cutter blade is operated by the user may be provided.

According to the first through third embodiments, a transmissive photosensor is used as the medium detection sensor 99. However, a reflection type photosensor, and a mechanical switch are also available as the medium detection sensor 99.

Further, instead of the CPU 81 as the processor, a microcomputer, ASIC (Application Specific integrated Circuits), and FPGA (Field Programmable Gate Array) are also available. Further, each of the first through third main routines may be executed by performing distributed processing using a plurality of processors. Any type of storage media can be employed as the non-transitory storage medium regardless of a period of time during which the medium can store information, as long as the media are capable of storing data. The non-transitory storage medium may not include a transitory storage medium such as a transmitted signal. The program may be downloaded through a server connected to a network, i.e., may be transmitted in the form of transmitted signals, and may be stored in the flash memory 82. In the latter case, the program may be stored in a non-transitory storage medium such as a hard disc provided in the server. Further, the above-described embodiments may be combined together avoiding any technical confliction.

The thermal head 60 is an example of the printing head. The conveying roller 66 is an example of the conveyor. The discharge roller 22 is an example of the discharge roller. The cutting blade 12 is an example of a cutter. The discharge roller 22 is an example of the discharge roller. The counter roller 23 is an example of the counter roller. The discharge motor 93 is an example of a driver. The CPU 81 is an example of the controller. The CPU 81 that executes the process in S13 is an example of the (a) controlling. The print control first executed by the CPU 81 is an example of the first print control. The subsequent control is an example of the second print control. The CPU 81 that executes the process in S14 is an example of the (b) driving. The CPU 81 that executes the process in S17 is an example of the (c) driving. The medium detection sensor 99 is an example of the sensor. The CPU 81 that executes the process in S12 is an example of the (a) controlling. The CPU 81 that executes the process in S13 is an example of the (b) controlling. The CPU 81 that executes the process in S14 is an example of the (c) controlling. The CPU 81 that executes the process in S15 is an example of the (d) controlling. The CPU 81 that executes the process in S16 is an example of the (e) preventing. The CPU 81 that executes the process in S17 is an example of the (f) controlling. The CPU 81 that executes the process in S17 to S11 is an example of the (g) permitting.

What is claimed is:

1. A printer comprising:

a printing head configured to perform printing on a medium;

a conveyor configured to convey the medium in a conveying direction;

a cutter positioned downstream of the printing head and the conveyor in the conveying direction, the cutter being configured to cut the medium to provide a segmented medium;

a discharge roller positioned downstream of the cutter in the conveying direction;

a counter roller positioned to face the discharge roller and configured to nip the medium in cooperation with the discharge roller;

a driver configured to drivingly rotate the discharge roller in a discharging direction, rotation of the discharge roller in the discharging direction causing the segmented medium to be conveyed downstream in the conveying direction; and a controller configured to perform:

(a) controlling, when a first print instruction has been acquired, the printing head and the conveyor to perform a first print control on the medium, the first print control being first performed based on the acquired first print instruction to perform printing on the medium;

(b) driving, when performing the (a) controlling, the driver to stop rotation of the discharge roller in a state where the medium is nipped at a portion between the discharge roller and the counter roller; and (c) driving, when a second print control is allowed to be performed, the driver to drivingly rotate the discharge roller in the discharging direction, the second print control being performed subsequent to the first print control based on a second print instruction acquired subsequent to the first print instruction to perform printing on the medium.

2. The printer according to claim 1, further comprising a platen roller configured to nip the medium in cooperation with the printing head, the platen roller being configured to be drivingly rotated by the driver, wherein, in the (c) driving, the driver drivingly rotates the discharge roller in the discharging direction without drivingly rotating the platen roller.

3. The printer according to claim 1, wherein, when an instruction inputted by a user has been acquired, the second print control is allowed to be performed.

4. The printer according to claim 1, further comprising a sensor positioned downstream of the cutter in the conveying direction, the sensor being configured to detect whether the segmented medium remains at the portion between the discharge roller and the counter roller, wherein, when it is determined that the sensor detects that the segmented medium has been removed from the portion between the discharge roller and the counter roller, the second print control is allowed to be performed.

5. The printer according to claim 4, wherein the sensor is positioned downstream of the discharge roller in the conveying direction.

6. The printer according to claim 1, wherein the (c) driving drives the driver by a prescribed amount to cause the discharge roller to rotate in the conveying direction, and wherein the second print control is performed after performing the (c) driving.

7. The printer according to claim 6, wherein the prescribed amount is smaller than a first amount, the first amount being a driving amount of the driver for conveying the segmented medium by a first distance, the first distance being a distance in the conveying direction from the printing head to the discharge roller.

8. The printer according to claim 6, wherein the prescribed amount is greater than a second amount, the second amount being a driving amount of the driver for conveying the segmented medium by a second distance, the second distance being a distance in the conveying direction from the cutter to the discharge roller.

9. A printer comprising:

a printing head configured to perform printing on a medium;

a platen roller configured to nip the medium in cooperation with the printing head;

a cutter positioned downstream of the printing head and the platen roller in a conveying direction in which the medium is conveyed, the cutter being configured to cut the medium to provide a segmented medium;

a discharge roller positioned downstream of the cutter in the conveying direction and movable between a release position and a nipping position;

a counter roller positioned to face the discharge roller, the counter roller being configured to nip the medium in cooperation with the discharge roller at the nipping position, the counter roller being spaced away from the discharge roller at the release position to allow the medium to pass through a portion between the discharge roller and the counter roller;

a sensor positioned downstream of the discharge roller and the counter roller in the conveying direction, the sensor being configured to detect whether the segmented medium remains at the portion between the discharge roller and the counter roller; and a controller configured to perform:

(a) controlling, when a first print instruction has been acquired, the discharge roller to be moved to the release position;

(b) controlling the printing head and the platen roller to perform printing on the medium based on the acquired first print instruction;

(c) controlling, after completing the (h) controlling, the discharge roller to be moved to the nipping position;

(d) controlling the cutter to provide the segmented medium;

(e) preventing, when it is determined that the sensor detects that the segmented medium remains at the portion between the discharge roller and the counter roller, a second print instruction from being received, the second print instruction being acquired subsequent to the first print instruction to perform printing on the medium;

(f) controlling, when it is determined that the sensor detects that the segmented medium has been removed from the portion between the discharge roller and the counter roller, the discharge roller to be rotated in a discharging direction; and (g) permitting, after performing the (f) controlling, the second print instruction to be received.

* * * * *